US005215402A

United States Patent [19]

Stowell et al.

[11] Patent Number: 5,215,402

[45] Date of Patent: Jun. 1, 1993

[54] ASPHALT IMPRINTING METHOD AND APPARATUS

[75] Inventors: Claude C. Stowell, Kelowna; Norman J. Zaseybida, West Bank, both of Canada

[73] Assignee: Integrated Paving Concepts, Inc., Surrey, Canada

[21] Appl. No.: 786,526

[22] Filed: Nov. 1, 1991

[51] Int. Cl.[5] ..... B05D 1/32

[52] U.S. Cl. ..... 404/93; 404/94

[58] Field of Search ..... 404/72, 87, 89, 93, 404/94, 75

[56] References Cited

U.S. PATENT DOCUMENTS 5,133,621 7/1992 Gonzales ..... 404/93 X

FOREIGN PATENT DOCUMENTS 61205 3/1990 Japan ..... 404/93

2208883 4/1989 United Kingdom ..... 404/93

2214211 8/1989 United Kingdom ..... 404/93

*Primary Examiner*—William P. Neuder

*Attorney, Agent, or Firm*—Barrigar & Oyen

[57] ABSTRACT

A method and apparatus for imprinting a predefined pattern in a freshly rolled asphalt surface to simulate the appearance of bricks, cobblestones, interlocking paving stones or the like. A pliable, grid-like template is progressively compressed into the asphalt surface using a drum roller or other surface compactor. The template is then manually lifted clear of the asphalt surface and the asphalt is allowed to harden. The patterned asphalt surface may be treated with a thin coating of colored concrete to enhance the brick and mortar effect.

20 Claims, 4 Drawing Sheets

ASPHALT IMPRINTING METHOD AND APPARATUS

FIELD OF THE INVENTION

This application relates to a method and apparatus for imprinting a pre-defined pattern in a freshly rolled asphalt surface. More particularly, this invention relates to a method for impressing a pliable, grid-like template into an asphalt surface to simulate the appearance of bricks, cobblestones, interlocking paving stones or the like.

BACKGROUND OF THE INVENTION

In constructing driveways, walkways, roadways and the like three types of materials are typically used; namely, asphalt, concrete or paving stones. Interlocking paving stones are generally considered to result in a more aesthetically pleasing visual effect than unfinished asphalt or concrete, but they are relatively expensive to fabricate and install.

Various methods and apparatuses for imprinting surface patterns in cementitious materials, such as concrete, are known in the prior art. For example, U.S. Pat. Nos. 3,832,079 and 3,910,711 which issued to Moorhead on Aug. 27, 1974 and Oct. 7, 1975 respectively, relate to a method and apparatus for imprinting a pattern into uncured concrete. The Moorhead process involves the use of an axle mounted pattern roller having blades which are impressed into the uncured concrete to simulate the appearance of blocks, bricks, cobblestones and the like. A plastic film is positioned between the roller blades and the concrete surface to act as a release agent and to prevent binding or gouging of the concrete.

U.S. Pat. No. 4,105,354, which issued to Bowman on Aug. 8, 1978, teaches a wheel-like forming tool for imprinting surface patterns in a slab of freshly cast, plastic concrete. The concrete-penetrating blades are mounted on the exterior of the wheel frame in a gridlike fashion. A series of pattern forming wheels may be interconnected together to imprint large slabs of concrete, thus overcoming the disadvantages of fixed-width rollers, such as the Moorhead apparatus referred to above.

Such prior art concrete pattern forming methods and apparatuses are not specifically adapted for imprinting hot bitumastic surfaces, such as asphalt. For example, some plastic or rubber-based concrete pattern formers cannot withstand the high temperature of freshly rolled asphalt (typically on the order of 275°-300°). Similarly, some release agents for preventing adherence between the pattern former and the concrete surface are not suitable for use with hot, petroleum-based asphalt. Further, several of the prior art concrete forming tools are substantially rigid and would tend to bend or deform when impacted into the asphalt surface with a high degree of pressure (such as by using a double drum roller).

Accordingly, the need has arisen for a method and apparatus for imprinting freshly rolled asphalt surfaces to simulate the aesthetically pleasing features of cobblestones, interlocking paving stones and the like.

SUMMARY OF THE INVENTION

In accordance with the invention, a method for imprinting an asphalt surface is disclosed which includes the steps (a) providing a pliable template comprising one or more interconnectable template modules for impressing a pre-defined pattern in the asphalt surface, (b) positioning the template on the asphalt surface, (c) compressing the template into the asphalt surface using a compaction apparatus to leave an impression of the predefined pattern in the asphalt surface, (d) removing the compaction apparatus from the asphalt surface, and (e) lifting the template clear of the asphalt surface. The template is preferably impressed into the asphalt surface using a drum roller compaction apparatus after the asphalt is initially rolled and smoothed.

The imprinting method may include the further step of coating either the asphalt surface or the template with a release agent to minimize adherence between the asphalt surface and the template. Preferably, the release agent is diesel fuel coated on the template or, alternatively, concrete powder coated on the asphalt surface prior to the impressing step.

The concrete powder release agent may include a colourant for colouring the asphalt surface. The applicant's method may include the further step of applying water to the concrete powder after the template is lifted clear of the asphalt surface.

Advantageously, the pliable template comprises a plurality of template modules, each of the modules comprising a plurality of linked, elongated members, such as lengths of cable or rope. In the preferred embodiment, the template modules are loosely connected together in the desired pattern by means of connectors consisting of a plurality of studs spaced around the periphery of each template module, and projecting outwardly therefrom, and a plurality of tubular sleeves for receiving the studs of separate template modules when such modules are aligned adjacent one another.

BRIEF DESCRIPTION OF THE DRAWINGS

In drawings which illustrate an embodiment of the invention, but which should not be construed as restricting the spirit or scope of the invention in any way.

DETAILED DESCRIPTION OF THE PREFERRED EMBODIMENT

This application relates to a method and apparatus for imprinting a freshly rolled asphalt surface. Asphalt is hereinafter referred to in its generic sense as meaning a paving compound for constructing driveways and the like which consists of a combination of bituminous tar and an aggregate, such as sand or gravel.

Figure 1:
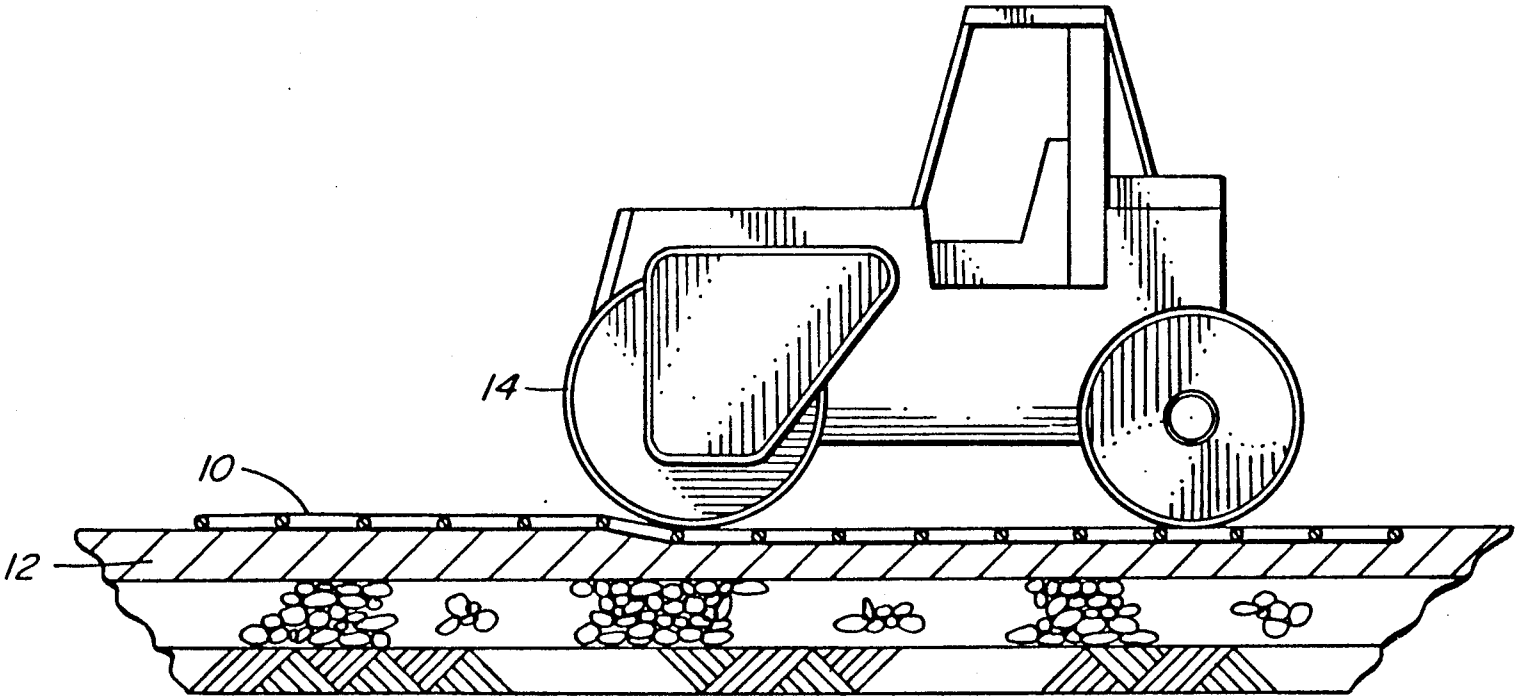
FIG. 1 is a diagrammatic side view of the applicant's asphalt imprinting method illustrating the step of impressing a pliable template into a freshly rolled asphalt surface using a double drum roller.

According to the method of the present invention, asphalt is imprinted with a patterned template constructed from a heat and pressure resistant material. With reference to FIG. 1, the preferred template is a grid 10 having a relatively narrow profile. Grid 10 is initially positioned on a freshly rolled asphalt surface 12 while it is still hot and pliable. Grid 10 is then progressively compressed into asphalt surface 12, such as by using a double drum roller 14, a vibrating plate tamper, or some other surface compactor. Following the compression step, grid 10 is manually lifted clear of asphalt surface 12 (FIG. 2) and the patterned asphalt is allowed to harden. In this manner, ordinary asphalt may be imprinted to simulate the appearance of interlocking paving stones, cobblestones, bricks or other aesthetically pleasing patterns.

Figure 2:
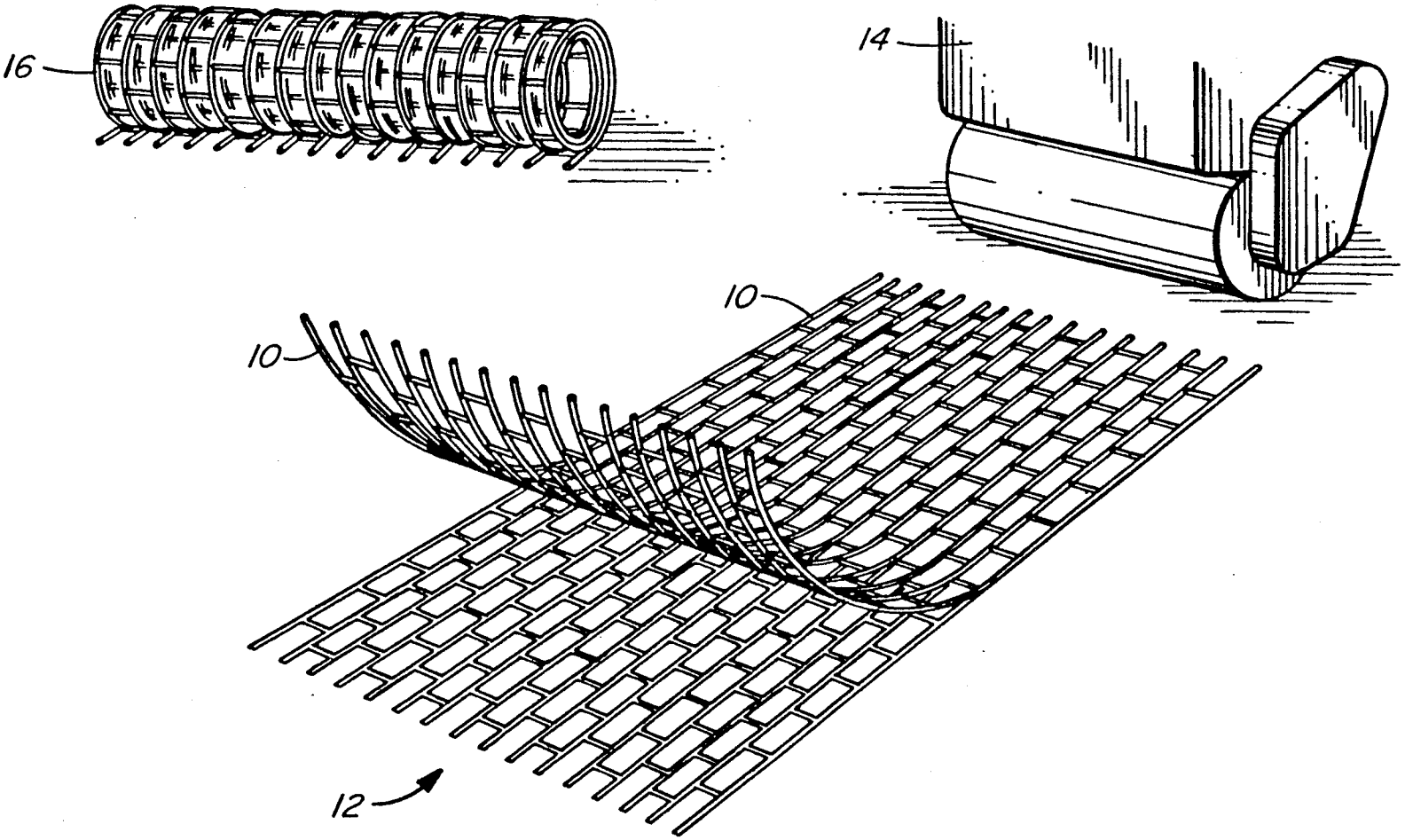
FIG. 2 is a perspective view of the template of FIG. 1 partially removed from the imprinted asphalt surface.
Figure 3:
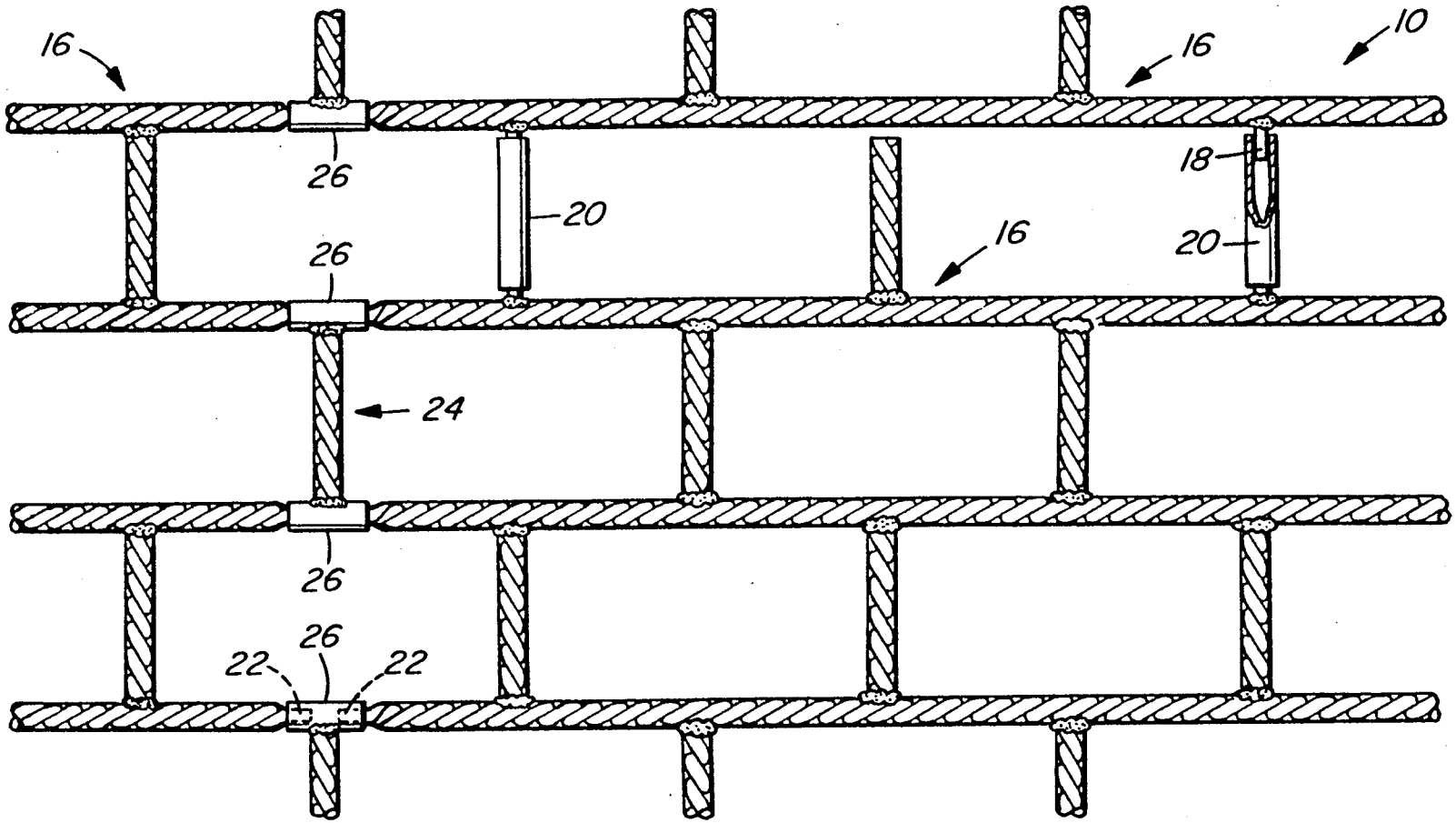
FIG. 3 is a fragmented, top plan view of the template of FIG. 1.
Figure 4:
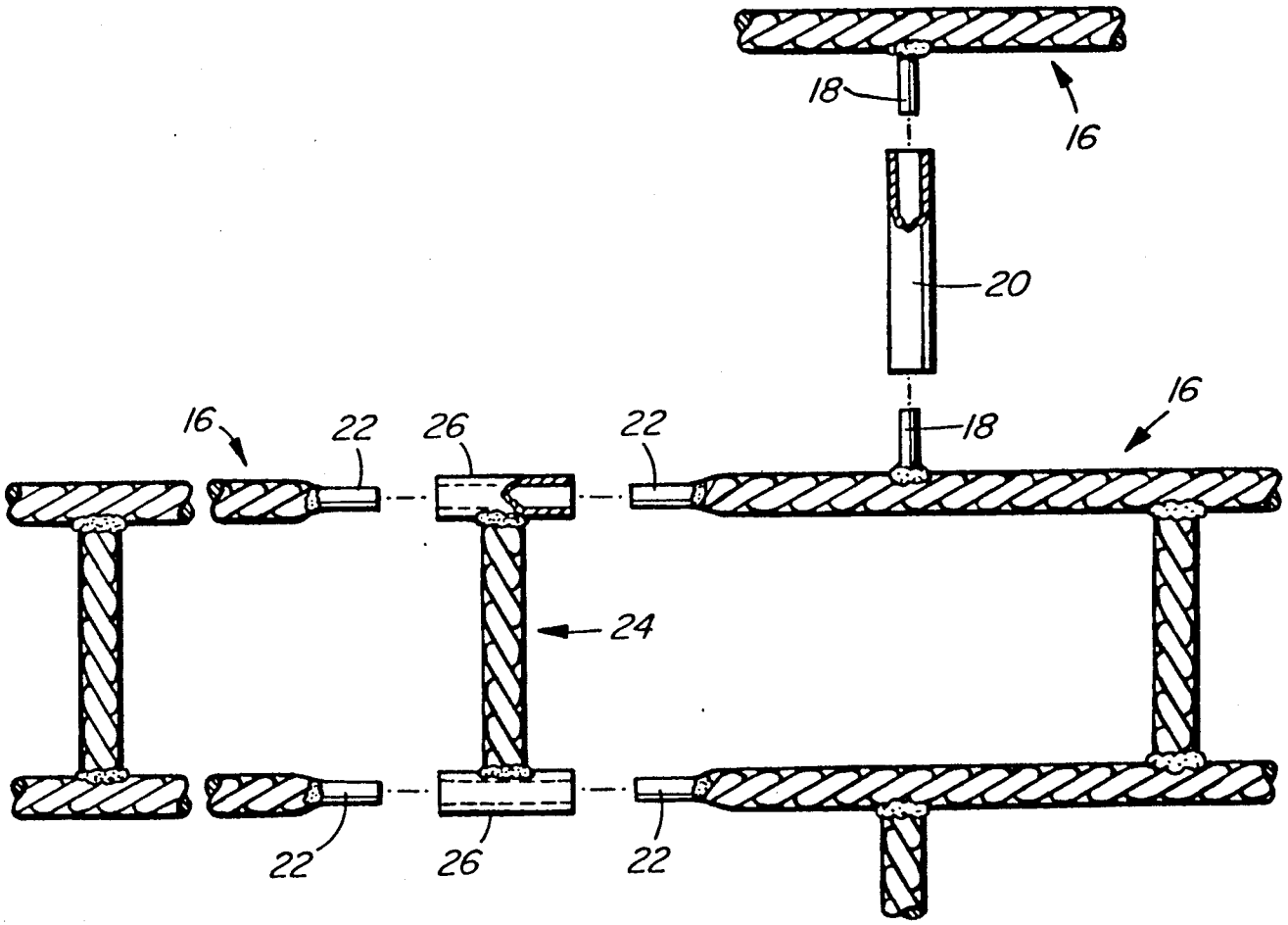
FIG. 4 is an enlarged, exploded, top plan view of a portion of the template of FIG. 3 showing the interconnection between separate template modules.

The structure of grid 10 is illustrated in further detail in FIGS. 3 and 4. Grid 10 preferably consists of a plurality of template modules, namely grid sections 16 which may be loosely connected together, as described further below, to conform to the size and shape of the asphalt surface 12 to be imprinted. Each grid section 16 is constructed from lengths of flexible cable which are connected together in the desired pattern. The cables may consist of braided steel, wire, rope or any other suitably pliable member which will not irreversibly bend or deform when subjected to high pressure and heat. The diameter of the grid cables may vary depending upon the pattern and depth of impression desired (cables between 0.25 and 2 inches in diameter are suitable for most applications). The grid pattern shown in FIGS. 2–4 is configured to produce a cobblestone or brick-like impression in asphalt surface 12.

Each grid section 16 has spaced-apart cylindrical studs 18 projecting outwardly from its top and bottom edges. As shown best in FIG. 4, studs 18 of adjacent grid sections 16 may be aligned and loosely connected by tubular sleeves 20. Similarly, the side edges of each grid section 16 include spaced-apart studs 22 which may be loosely connected to corresponding studs 22 on adjacent grid sections 16 by means of generally H-shaped connectors 24. As shown in FIG. 4, each connector 24 consists of a pair of parallel, spaced-apart tubular sleeves 26 joined by a length of flexible cable. Thus grid sections 16 may be readily interconnected without any tools and without disrupting the overall pattern formed by grid 10. Sleeves 20 and 26 may be crimped to ensure a snug mating fit with studs 18 and 22 respectively.

When not in use, each grid section 16 may be rolled into a compact bundle (FIG. 2) for storage or transport.

In operation, grid 10 is assembled from various grid sections 16 as described above and is positioned on asphalt surface 12 after it is initially rolled and smoothed. At such time, asphalt surface 12 is very hot (typically on the order of 275°–300° F.) and is in a plastic or semi-plastic state. According to one embodiment of the present invention, grid 10 may be coated with a petroleum-based release agent, such as diesel fuel, to minimize adherence between the grid cables and the hot asphalt surface 12. This facilitates removal of grid 10 after it has been compressed into asphalt surface 12 (FIG. 2).

In an alternative embodiment, concrete powder may be used as a release agent to minimize adherence between grid 10 and asphalt surface 12. The concrete powder is preferably sprinkled on the freshly rolled asphalt prior to the impression step. The concrete powder may be mixed with a colouring agent, such as an iron oxide powder or a synthetic colourant. After grid 10 is lifted clear of asphalt surface 12 following the impression step (FIG. 2), surface 12 is lightly sprayed with water and the resulting coloured concrete slurry is spread throughout surface 12 and allowed to harden. Thus, the normally black asphalt surface is covered with a thin coating of coloured concrete which results in the desired brick and mortar or simulated cobblestone effect. The cement coating also acts as a protective layer which reduces the heat absorbtivity of the asphalt.

Various other acrylic, epoxy, or latex-based protective coatings may be applied to asphalt surface 12 after the impression step to seal the imprinted asphalt surface and enhance the brick or cobblestone effect.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of imprinting an asphalt surface comprising:

(a) providing a pliable template comprising one or more releasably connectable template modules for impressing a predefined pattern in said asphalt surface;

(b) positioning said template on said asphalt surface;

(c) compressing said template into said asphalt surface using a compaction apparatus separate from said template to leave an impression of said predefined pattern in said asphalt surface;

(d) removing said compaction apparatus from said template; and (e) lifting said template clear of said asphalt surface.

2. The imprinting method of claim 1, wherein said template is impressed into said asphalt surface immediately after said asphalt surface is initially rolled.

3. The imprinting method of claim 1, further comprising the step of coating one of said asphalt surface or said template with a release agent to minimize adherence between said asphalt surface and said template.

4. The imprinting method of claim 3, wherein said release agent is concrete powder coated on said asphalt surface.

5. The imprinting method of claim 4, wherein said concrete powder comprises a colourant for colouring said asphalt surface.

6. The imprinting method of claim 5, further comprising the step of applying water to said concrete powder after said template is lifted clear of said asphalt surface.

7. The imprinting method of claim 1, wherein said compaction apparatus is a drum roller.

8. The imprinting method of claim 1, wherein said one or more template modules each comprise an open framework of linked elongated members.

9. The imprinting method of claim 1, wherein said linked members are lengths of semi-rigid steel cable of substantially constant diameter.

10. A pliable template for impressing a predefined pattern in an asphalt surface, said template comprising a plurality of interconnectable template modules, each of said modules comprising an open framework of linked elongated members.

11. The template as defined in claim 10, further comprising connector means for loosely interconnecting said template modules.

12. The template as defined in claim 11, wherein said connector means comprises:

(a) a plurality of studs spaced around the periphery of said template modules and projecting outwardly therefrom; and (b) a plurality of tubular sleeves having open ends for receiving the studs of separate modules when said modules are aligned adjacent one another.

13. The template as defined in claim 12, wherein a sub-group of said sleeves are integrally connected in substantially parallel relation by a length of flexible cable extending therebetween.

14. The template as defined in claim 10, wherein said elongated members are lengths of steel cable.

15. The template as defined in claim 14, wherein said cable is between 0.25 and 2 inches in diameter.

16. The template as defined in claim 14, wherein said cable has a substantially constant diameter.

17. The template as defined in claim 10, wherein said elongated members are lengths of rope.

18. The template as defined in claim 10, wherein said elongated members are lengths of wire.

19. A method of imprinting an asphalt surface comprising:

(a) providing a plurality of releasably connectable template modules for impressing a predefined pattern in said asphalt surface, each of said modules comprising an open framework of linked members;

(b) assembling said modules together to form a pliable template having a size approximating the surface area of said asphalt surface to be imprinted;

(c) positioning said template on said asphalt surface shortly after said asphalt surface is initially rolled;

(d) progressively compressing said template into said asphalt surface using a compaction apparatus separate from said template to leave an impression of said predefined pattern in said asphalt surface;

(e) removing said compaction apparatus from said template;

(f) lifting said template clear of said asphalt surface; and (g) disassembling said template by disconnecting said template modules.

20. A method of imprinting an asphalt surface comprising:

(a) providing a pliable template comprising one or more releasably connectable template modules for impressing a predefined pattern in said asphalt surface, said one or more template modules comprising an open framework of linked members;

(b) positioning said template on said asphalt surface;

(c) progressively compressing said template into said asphalt surface using a compaction apparatus separate from said template to leave an impression of said predefined pattern in said asphalt surface;

(d) removing said compaction apparatus from at least one of said template modules;

(e) lifting said template module clear of said asphalt surface; and (f) repeating steps (d) and (e) until all of said template is clear of said aphalt surface.

* * * * *